US006210812B1

(12) United States Patent
Hasz et al.

(10) Patent No.: US 6,210,812 B1
(45) Date of Patent: Apr. 3, 2001

(54) THERMAL BARRIER COATING SYSTEM

(75) Inventors: Wayne Charles Hasz, Pownal, VT (US); Jeffrey Allen Conner, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/304,278

(22) Filed: May 3, 1999

(51) Int. Cl.[7] ..... B32B 15/00

(52) U.S. Cl. ..... 428/621; 428/633; 428/652; 428/653; 428/678; 428/680; 416/241 B

(58) Field of Search ..... 428/621, 633, 428/652, 653, 678, 680; 416/241 B

(56) References Cited

U.S. PATENT DOCUMENTS 5,066,459 * 11/1991 Beltram et al. ..... 420/58.8
5,455,119 10/1995 Taylor et al. .
5,523,169 6/1996 Rafferty et al. .
5,716,720 2/1998 Murphy .
5,763,107 6/1998 Rickerby et al. .
5,780,110 7/1998 Schaeffer et al. .
5,783,318 * 7/1998 Biondo et al. ..... 428/680
5,817,371 10/1998 Gupta et al. .
5,817,372 10/1998 Zheng .
5,824,423 10/1998 Maxwell et al. .
5,830,586 11/1998 Gray et al. .
5,856,027 1/1999 Murphy .
5,866,271 2/1999 Stueber et al. .
5,871,820 2/1999 Hasz et al. .

* cited by examiner

*Primary Examiner*—Timothy M. Speer
*Assistant Examiner*—Bryant Young
(74) *Attorney, Agent, or Firm*—Noreen C. Johnson; Douglas E. Stoner

(57) ABSTRACT

An article includes a substrate and an adhesion layer overlying the substrate. The adhesion layer includes a first phase including particles, and a second phase including braze alloy that bonds the particles to the substrate. The article further includes a ceramic layer overlying the adhesion layer. In one embodiment, the ceramic layer is a thermal barrier coating (TBC), formed of stabilized zirconia ($ZrO_2$).

31 Claims, 1 Drawing Sheet

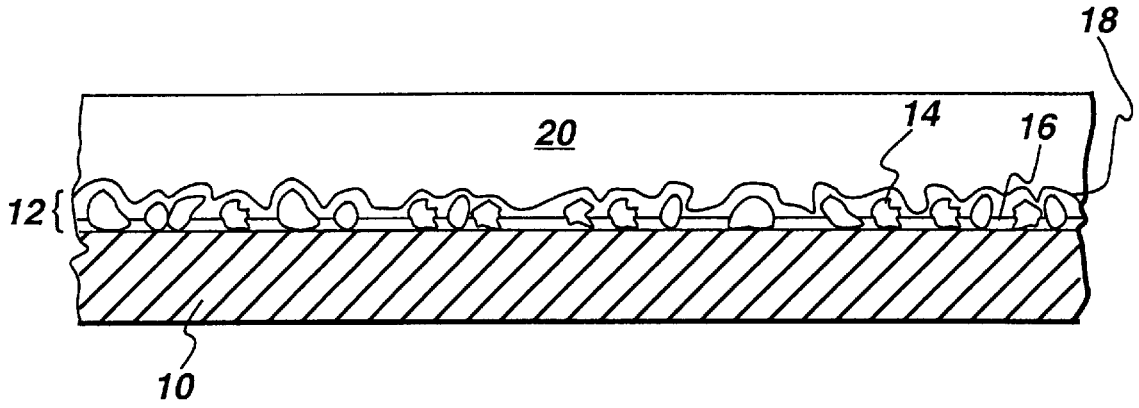
18
20
14
16
12
10

THERMAL BARRIER COATING SYSTEM

BACKGROUND OF THE INVENTION

The invention relates generally to thermal barrier coating systems, in particular, thermal barrier coating systems exposed to high temperatures, such as in a gas turbine engine.

Higher operating temperatures for gas turbine engines have been continuously sought in the art in order to improve the operating efficiency of the engine. However, as operating temperatures are raised, the high temperature capabilities of the components in the engine must also increase. To this end, various nickel-base and cobalt-base superalloys have been employed, which incorporate oxidation-resistant and corrosion-resistant overlay and diffusion-type coatings.

Further improvements in the high temperature capabilities of components have been realized by coating engine components with a thermal barrier coating (TBC), in addition to the overlay and diffusion-type coatings mentioned above. TBCs are generally formed of ceramic materials, such as zirconia ($ZrO_2$) stabilized by an oxide material. To promote adhesion between the thermal barrier coating and the underlying substrate, bond coats are utilized. One type of bond coat is formed of MCrAlY, wherein M is chosen from the group consisting of iron, cobalt, nickel and combinations thereof.

Such bond coats may be deposited by various techniques, including electron beam physical vapor deposition (EBPVD), as well as plasma spray techniques, including low pressure plasma spray (LPPS), and air plasma spray (APS). Of these bond coats, APS bond coats have been used for their ease of deposition.

The present inventors have recognized deficiencies with thermal barrier coating systems including air plasma sprayed bond coats. Particularly, the air plasma sprayed bond coat may have insufficient roughness to promote good adhesion of the thermal barrier coating thereto. In addition, the TBC system has tended to fail at the interface between the TBC and the bond coat, due to propagation of cracks along interface.

One technique that addresses the surface roughness of the bond coat is U.S. Pat. No. 5,817,372, to Zheng, commonly owned by the present assignee. The disclosed technique deposits a bond coat utilizing vacuum plasma spraying (VPS) technique or high velocity oxy-fuel (HVOF) technique. Two metal powders are utilized for deposition, including one having a fine particle size distribution, and another having a coarser particle size distribution. The fine particles preferentially melt during the deposition process. Upon solidification, the coarser particles are bonded to the substrate.

It would be desirable in the art to provide a thermal barrier coating system that has improved durability and robustness, while providing improved resistance to oxidation and corrosion at high temperatures.

SUMMARY OF THE INVENTION

In one aspect, the present invention is drawn to an article including a substrate, an adhesion layer overlying the substrate, and a ceramic layer overlying the adhesion layer. The adhesion layer includes a first phase of particles and a second phase of braze alloy that bonds the particles to the substrate.

In another aspect of the invention, a method for treating a substrate is provided, including the steps of providing a substrate, overlying an adhesion layer on the substrate, fusing the adhesion layer to the substrate, and depositing a ceramic layer to overlie the adhesion layer. The adhesion layer includes a first phase of particles, and a second phase of braze alloy. During the fusing step, the second phase melts to fuse the first phase of particles to the substrate.

Other details regarding various embodiments of the invention are provided below.

BRIEF DESCRIPTION OF THE DRAWINGS

The FIGURE illustrates an elevated cross-sectional view of an embodiment of the present invention.

While various elements have been shown in the FIGURE, it is understood that the elements are not necessarily drawn to scale.

DETAILED DESCRIPTION OF THE INVENTION

According to an embodiment of the present invention, a substrate, such as in the form of a turbine engine component is treated so as to improve its high temperature performance, such as at temperatures above 1000° C. The substrate is typically formed of a superalloy material, known for high temperature performance in terms of tensile strength, creep resistance, oxidation resistance, and corrosion resistance, for example. The superalloy component is typically formed of a nickel-base or a cobalt-base alloy, wherein nickel or cobalt is the single greatest element in the superalloy by weight. Illustrative nickel-base superalloys include at least about 40 wt % Ni, and at least one component from the group consisting of cobalt, chromium, aluminum, tungsten, molybdenum, titanium, and iron. Examples of nickel-base superalloys are designated by the trade names Inconel®, Nimonic®, Rene® (e.g., Rene®80–, Rene®95, Rene®142, and Rene®N5 alloys), and Udimet®, and include directionally solidified and single crystal superalloys. Illustrative cobalt base superalloys include at least about 30 wt % Co, and at least one component from the group consisting of nickel, chromium, aluminum, tungsten, molybdenum, titanium, and iron. Examples of cobalt-base superalloys are designated by the trade names Haynes®, Nozzaloy®, Stellite® and Ultimet®. The actual configuration of a substrate may vary widely, such as in the form of a combustor liner, combustor dome, shroud, bucket or blade, nozzle or vane.

According to an embodiment of the present invention, an adhesion layer is provided so as to overlie the substrate either directly in contact with the substrate or with an intermediate layer in between, such as a bond coat, discussed in more detail below. The adhesion layer includes a first phase formed of particles, and a second phase formed of braze alloy that bonds the particles to the substrate. According to a particular embodiment of the present invention, the adhesion layer is used in combination with a bond coat for promoting adhesion of an overlying ceramic layer, typically a thermal barrier coating (TBC) overlying the substrate. The adhesion layer is provided to enhance adhesion of the thermal barrier coating to the substrate. The particular details of the adhesion layer, the bond coat and the thermal barrier coating are described hereinbelow.

Referring to the FIGURE, an embodiment of the present invention is illustrated including substrate 10, on which is formed adhesion layer 12. Adhesion layer 12 includes a first phase formed of a plurality of particles 14, and a second phase formed by solidified braze alloy 16.

Adhesion layer 12 may be formed on the substrate according to various techniques. In one embodiment of the invention, the adhesion layer 12 is deposited by placing a brazing sheet, such as in the form of a green (unsintered) braze tape or a braze foil, on the substrate and fusing the brazing sheet to the substrate.

The brazing sheet contains a braze alloy generally having a composition similar to that of a substrate. For example, if the substrate is a nickel-base superalloy, the braze alloy is also generally a nickel-base braze composition. Alternatively, nickel-base or cobaltbase braze alloys may be used with cobalt-base superalloy substrates. The braze alloy composition also typically contains one or more components for lowering the melting point of the braze alloy to ensure that the braze alloy melts in a temperature range lower than that of the first, particulate phase, and lower than any underlying material. Melting point suppressants for nickel-base and cobalt-base braze alloys include silicon, boron, phosphorous, or combinations thereof. Preferably, the melting point suppressant is one of silicon or boron, or a combination thereof. Exemplary nickel-base braze alloy compositions include the following. The following components are designated in weight %:

1. 4.5 Si, 14.5 Cr, 3.3 B, and 4.5 Fe, balance Ni;
2. 15 Cr, 3.5 B, balance Ni;
3. 4.5 Si, 3 B, balance Ni;
4. 4.2 Si, 7 Cr, 3 B, 3 Fe, balance Ni;
5. 10 Si, 19 Cr, balance Ni;
6. 3.5 Si, 22 Co, 2.8 B, balance Ni;
7. 3.5 Si, 1.8 B, balance Ni;
8. 4.5 Si, 14 Cr, 3 B, 4.5 Fe, balance Ni;
9. 17 Cr, 9 Si, 0.1 B, balance Ni;
10. 2.6 Si, 2 Cr, 2 B, 1 Fe, balance Ni;
11. 15 Cr, 8 Si, balance Ni;

Other nickel-base braze alloy compositions include:

12. 10.1 Si, 19.0 Cr, balance Ni;
13. 4.5 Fe, 4.5 Si, 14.0 Cr, 3.1 B, 0.75 C, balance Ni;
14. 4.5 Fe, 4.5 Si, 14.0 Cr, 3.1 B, balance Ni;
15. 4.5 Si, 3.1 B, balance Ni;
16. 11.0 P, balance Ni; and
17. 10.1 P, 14.0 Cr, balance Ni.

Cobalt-base braze alloy compositions include:

1. 8 Si, 19 Cr, 17 Ni, 4 W, 0.8 B, balance Co
2. 17.0 Ni, 1.0 Fe, 8.0 Si, 19.0 Cr,.0.8 B, 0.4 C, balance Co.

In the case of a green braze tape, the tape may be formed from a slurry containing a liquid medium such as water, organic solvent, or mixture thereof, a braze alloy, and a binder. Examples of binders include water-base organic materials such as polyethylene oxide and various acrylics, as well as solvent-base binders. The slurry is typically tape cast onto a removable support sheet, such as a plastic sheet. The slurry is then dried, wherein the liquid medium including any volatile material therein is evaporated. The resulting green braze tape typically has a thickness in a range of about 1 micron to 250 microns, preferably in a range of about 50 microns to about 150 microns. Alternatively, braze tapes containing nickel-base or cobalt-base braze alloys are commercially available. An example of such a product is the Amdry line of braze tapes, available from Sulzer Metco.

In another embodiment, the brazing sheet containing braze alloy is in the form of a metal foil, which is similar to a green braze tape, but which contains no binder. Metal foils are typically formed by one of various techniques, including by melt spinning, sintering a green braze tape, or by thermal spray. The metal foil typically has a thickness on the order of about 0.1 microns to about 2500 microns, such as about 25 microns to about 200 microns.

The particulate phase 14 of adhesion layer 12 is typically applied on a surface of the brazing sheet, either in the form of the green braze tape or metal foil described above. The particulate phase 14 is formed of a coarse powder of superalloy particles that, upon fusing to substrate 10, form an outer roughened surface. The roughened surface is characterized by having a plurality of bumps along the outer surface of the adhesion layer 12.

In one embodiment, the particulate phase 14 is comprised of nickel-base or cobalt-base superalloy particles, wherein nickel or cobalt is the single greatest element of the superalloy by weight. In this regard, the composition of the superalloy particles may be similar to the composition of substrate 10 or bond coat. The particulate phase 14 is generally formed of a composition including at least one element selected from the group consisting of nickel, cobalt, and iron. A particular example of the composition of the particulate phase 14 is a superalloy having a general formula MCrAlY wherein M is an element from the group consisting iron, nickel, cobalt and combinations thereof. In a particular embodiment, the particles of particulate phase 14 may have a composition in a range of about 17.0–23.0 wt. % chromium, about 4.5–12.5 wt. % aluminum, about 0.1–1.2 wt. % yttrium, and a balance of M.

The particles of the particulate phase 14 typically have an average particle size on the order of about 125 to about 4000 microns, such as 150 to about 2050 microns. In a preferred embodiment, the average size of the particles is in the range of about 180 to about 600 microns. The particulate phase 14 generally has a higher melting or softening point than that of the braze alloy such that the particulate phase 14 remains largely intact through the fusing operation, to achieve the desired roughness of layer 12.

In the case of a green braze tape or a metal foil, the particulate phase is generally applied to a major surface of the tape or foil. Prior to application of the particulate phase thereon, an adhesive is generally applied to the foil or tape to hold the particles in place prior to fusing on the substrate. Any particular adhesive may be used, provided that it completely volatilizes during the subsequent fusing step. Illustrated examples of adhesives include polyethylene oxide and acrylic materials. A particular commercial example includes "4B Braze Binder" from Cotronics Corp. The adhesive may be applied utilizing one of various techniques including spraying or coating using a liquid adhesive, or applying a mat or film of double-sided adhesive tape.

In some embodiments, the particulate phase is patterned on the surface of the brazing sheet. A variety of techniques exist for patterning, for example, applying the particulate phase through a screen, such as by a screen printing technique. In this embodiment, the screen has apertures of a pre-selected size and arrangement, depending upon the desired size and arrangement of the particles of the particulate phase. In an alternative embodiment, a braze adhesive is applied through a screen and onto the brazing sheet to form a pattern of adhesive. Application of the powder to sheet results in placement of particles only where adhesive is present, replicating the pattern of adhesive.

In an alternative embodiment, the particulate phase is mixed with a liquid medium, braze alloy powder, and a binder to form a green braze tape integrally containing the particulate phase.

Following formation of a brazing sheet including a braze alloy component and a particulate phase component, the brazing sheet is applied to the substrate 10. The brazing sheet is typically attached to the substrate 10 by simple means prior to fusing, including use of an adhesive between the brazing sheet and substrate 10. Suitable adhesives are described above in connection with application of the particulate phase 14 to the brazing sheet. Alternatively, in the case of a green braze tape, the sheet may be exposed to a solvent that partially dissolves and plastizes the binder, causing the tape to conform and adhere to the substrate surface. Examples of solvents include toluene, acetone, or another organic solvent that can be sprayed or brushed on to the green braze tape after placing the tape on the substrate.

In alternative embodiments, the braze alloy and particulate phase are deposited on the substrate by application of a slurry, or by spraying. In addition, in one embodiment, the materials are. deposited by pre-treating the substrate with an adhesive followed by sprinkling of powders of the braze alloy and particulate phase. In this case, the powders of the braze alloy and particulate phase may be deposited simultaneously or sequentially. If sequentially, a first layer of adhesive is generally applied to the underlying substrate, followed by sprinkling of braze alloy powder thereon. Then a second layer of adhesive is applied over the adhered braze alloy powder, followed by sprinkling of the particulate phase thereon.

The deposited material containing the braze alloy component and the particulate phase component is then fused to the substrate. Because the braze alloy generally has a melting point lower than that of the particulate phase 14, the braze alloy preferentially melts during fusing leaving the particulate phase 14 substantially intact. The difference in melting points between the particulate phase 14 and the braze alloy is typically achieved by use of a melting point suppressant in connection with the braze alloy, as discussed above. The difference in melting points between the compositions is typically at least about 50° C., such as at least about 75° C.

Generally, the fusing step is carried out by brazing, wherein the braze alloy melts, without any attendant melting of substrate 10 or significant melting of the particulate phase 14. The brazing temperature is largely dependent upon the type of braze alloy used, but is typically in a range of about 525° C. to about 1650° C. In the case of nickel-base braze alloys, braze temperatures are typically in the range of about 800° C. to about 1260° C.

In one embodiment, brazing is carried out in a furnace having a controlled environment, such as a vacuum or an inert atmosphere. Fusing in a controlled environment advantageously prevents oxidation of the braze alloy and underlying materials including the substrate during heating. In the case of a vacuum furnace, the vacuum is typically in a range of about $10^{-1}$ Torr to about $10^{-8}$ Torr achieved by evacuating ambient air from the vacuum chamber of the furnace. In one particular embodiment, brazing is carried out at a pressure of about $5\times10^{-4}$ Torr. In the case of large substrates that are difficult to place in a furnace, a torch or other localized heating means is be used to effect brazing. Exemplary heating means include gas welding torches (e.g., oxy-acetylene, oxy-hydrogen, air-acetylene, and air-hydrogen RF (radio frequency) welding, TIG (tungsten inert gas) welding, electron-beam welding, resistance welding, and use of IR (infra-red) lamps. In connection with such heating means, a flux or inert cover gas may be implemented, particularly for braze compositions that are free of boron.

Following heating so as to fuse the brazing sheet to the substrate, the braze alloy is permitted to cool, forming a metallurgical bond to the underlying material and mechanically retaining the particulate phase within the solidified braze alloy forming a matrix phase. During brazing and in subsequent elevated temperature exposures, the melting point suppressants in some cases are diffused out of the braze alloy such that the melting point of the final matrix phase is higher than the starting point, thereby yielding the desired high temperature capability required as part of the thermal barrier coating system. As shown in the FIGURE, the braze alloy forms a film that is a continuous matrix phase. As used herein, "continuous" matrix phase denotes an uninterrupted film along the treated region of the substrate, between particles of the particulate phase. Alternatively, the film of braze alloy is not continuous, but rather, is only locally present to bond individual particles to the substrate. In this case, the film of braze alloy is present in the form of localized fillets surrounding discrete particles or clusters of particles. In either case, thin portions of the film may extend so as to coat or partially coat particles of the particulate phase.

The thickness of the braze alloy film 16 is typically chosen to ensure adequate roughness of the adhesion layer 12. By way of example, the thickness of braze alloy 16 is on the order of about 20 microns to about 100 microns, more particularly, about 30 microns to about 70 microns. The resulting adhesion layer typically has a center line average roughness value (Ra) on the order of about 100 to about $10^4$ microinches, such as 100 to 1000 microinches.

Following formation of adhesion layer 16, bond coat 18 is deposited thereon. Bond coat 18 typically has a superalloy composition such as MCrAlY, wherein M is selected from a group consisting of iron, cobalt, nickel and combinations thereof. In one particular embodiment, the bond coat includes about 17.0 to about 23.0 wt. % Cr, about 4.5 to about 12.5 wt. % Al, and about 0.1 to about 1.2 % Y and a balance of Ni. The bond coat typically has a thickness within a range of about 25 microns to about 750 microns, such as about 100 microns to about 400 microns. The bond coat is generally deposited by one of several techniques such as by a thermal spray technique, including high-velocity oxy-fuel (HVOF) and plasma spray techniques. Plasma spray techniques include air plasma spray (APS), vacuum plasma spray (VPS), and low pressure plasma spray (LPPS). Alternatively, vapor deposition techniques, such as electron beam physical vapor deposition (EBPVD) can be utilized.

In one embodiment the bond coat is deposited according the following process conditions. A Metco 7MB plasma spray torch was placed about 5 inches from a 1 inch by 2 inch coupon, and Ni211 powder (−325 mesh) was fed to the torch. The torch current was set at 500A to form the bond coat.

As depicted in the FIGURE, according to an embodiment of the invention, the bond coat 18 advantageously mimics or follows the roughness characteristics of adhesion layer 12, by following the contour of the roughened surface of the adhesion layer. The bond coat typically has a center line average roughness value (Ra) on the order of about 100 to about $10^4$ microinches, such as 100 to 1000 microinches.

Subsequently, a ceramic layer, particularly a thermal barrier coating (TBC) 20, is deposited on the bond coat 18. The thermal barrier coating is typically formed of zirconia, stabilized with at least one oxide, including yttria ($Y_2O_3$), ceria ($CeO_2$), magnesia (MgO), and scandia ($Sc_2O_3$), and calcia. In one particular embodiment, the thermal barrier coating is formed of yttria stabilized zirconia. The thermal barrier coating is generally deposited by one of several techniques such as by a thermal spray technique, including high velocity oxy-fuel (HVOF) and plasma spray techniques. Plasma spray techniques include air plasma spray (APS), vacuum plasma spray (VPS), and low pressure plasma spray (LPPS). Alternatively, vapor deposition techniques, such as electron beam physical vapor deposition (EBPVD) can be utilized. The thermal barrier coating typically has a thickness on the order of about 50 microns to about 2500 microns, such as about 75 microns to about 1250 microns. Typically, the thickness of the bond coat was less than about 500 microns, such as 400 microns.

According to a particular embodiment of the invention, both the bond coat and the thermal barrier coating are both deposited by air plasma spray. While the thermal barrier coating is depicted as a single layer, it may be in the form of multiple layers formed by multiple passes of a plasma spray torch over the substrate. For example, in one embodiment, the thermal barrier coating was deposited by feeding −120 mesh Metco HSOP yttria stabilized zirconia (YSZ) powder at a rate of 3 lb/hr to a DC plasma spray torch, model 7MB made by Metco, Inc. The powder contained 8 wt % yttria, the balance being zirconia. The torch current density was about 600A, and the temperature of the substrate was on the order of 250° C. Sixty passes were made over the substrate, each pass forming a sub-layer having a thickness of about 0.0003 inches. Additionally, in another embodiment the thermal barrier coating is formed of layers of different compositions of materials.

In a particular embodiment of the invention, a diffusion coating step is added to aluminide the bond coat. Diffusion coating is typically carried out by the known pack cementation process, or by a vapor phase technique. According to an embodiment of the present invention, which calls for the use of an adhesion layer to enhance the roughness of the bond coat, the diffusion coating is advantageously carried out by a vapor phase deposition process. The present inventors have recognized that adequate roughness of the bond coat may be maintained even with the addition of a vapor phase deposited aluminum layer, which otherwise has a tendency to reduce the roughness of the bond coat, and hence provide less than desirable adhesion of the thermal barrier coating to the substrate.

By diffusion coating the bond coat, various aluminide intermetallics are formed along the top surface of the bond coat. The intermetallics are achieved by diffusion of the aluminum into the bond coat at an elevated temperature. As a result, the top surface of the bond coat is aluminum rich. Upon exposure to oxygen, a protective alumina scale is formed along the bond coat, on which the ceramic layer 20 is deposited.

In one particular variation of an embodiment of the invention, the bond coat 18 is first deposited directly on substrate 10, followed by application of adhesion layer 12. In this particular variation, diffusion coating of the bond coat is carried out subsequent to the deposition of the adhesion layer 12, whereby the adhesion layer and any exposed portions of the bond coat are aluminized. The fusing of the adhesion layer on the bond coat is advantageously carried out contemporaneously with the diffusion coating, since the diffusion coating is deposited at an elevated temperature and will effect brazing of the particulate phase 14 of the adhesion layer 12 to the bond coat 18.

According to embodiments of the present invention, an improved thermal barrier coating system is provided. Improved adhesion of the thermal barrier coating to the underlying substrate is effected by incorporation of an adhesion layer, which improves the mechanical interlocking of the thermal barrier coating to the substrate. In addition, the adhesion layer is effective to prevent or restrain crack propagation at the interface between the thermal barrier coating and the underlying material, such as the bond coat or the adhesion layer. Prevention of crack propagation is due to a roughened, non-planar interface between the thermal barrier coating and the underlying material, which is effective to blunt cracks that would have otherwise traveled unimpeded along the interface.

Further, according to embodiments of the present invention, the adhesion layer is first deposited so as to overlie the substrate (and any layers already deposited thereon), and then, in a separate step, is subsequently fused. By this technique, internal coating oxidation of the adhesion layer is prevented, as compared to a layer that is deposited and bonded to a substrate in a single step, such as in an HVOF process. Further, since presence of the adhesion layer provides increased surface roughness to promote adhesion of the thermal barrier coating to the substrate, a diffusion coating, such as an aluminide diffusion coating on the bond coat and/or the adhesion layer, is advantageously implemented while still maintaining desirable surface roughness.

While the thermal barrier coating systems are described above in particular detail, use of an adhesion layer containing a first phase formed of particulates and second phase of braze alloy may be used for enhancing adhesion of other materials to a substrate. For example, an adhesion layer may be used to enhance adhesion of other thermally sprayed coatings, such as carbides (e.g., tungsten carbide and chromium carbide), mullite, and alumina, to a substrate.

Various embodiments of the invention have been described herein. However, this disclosure should not be deemed to be a limitation on the scope of the claimed invention. Accordingly, various modifications, adaptations, and alternatives may occur to one skilled in the art without departing from the scope of the present claims.

What is claimed:

1. An article comprising:

a substrate;

an adhesion layer overlying the substrate, the adhesion layer comprising a first phase comprised of particles and a second phase comprised of braze alloy that bonds the particles to the substrate; and a ceramic layer overlying the adhesion layer.

2. The article of claim 1, further comprising a bond coat provided under the ceramic layer.

3. The article of claim 2, wherein the bond coat overlies the adhesion layer.

4. The article of claim 3, further comprising a diffusion coating on the bond coat.

5. The article of claim 4, wherein the diffusion coating comprises an aluminide.

6. The article of claim 3, wherein the adhesion layer is formed directly on the substrate.

7. The article of claim 2, wherein the adhesion layer overlies the bond coat.

8. The article of claim 7, further comprising a diffusion coating provided on the bond coat and the adhesion layer.

9. The article of claim 8, wherein the diffusion coating comprises an aluminide.

10. The article of claim 7, wherein the bond coat is formed directly on the substrate.

11. The article of claim 2, wherein bond coat comprises MCrAlY, wherein M is selected from the group consisting of iron, cobalt, nickel, and combinations thereof.

12. The article of claim 11, wherein the bond coat comprises about 17.0 to about 23.0 wt % Cr, about 4.5 to about 12.5 wt % Al, and about 0.1 to about 1.2 wt % Y, and a balance of M.

13. The article of claim 1, wherein the substrate comprises a superalloy.

14. The article of claim 13, wherein the superalloy is nickel-base or cobalt-base alloy, and wherein nickel or cobalt is the single greatest element of the superalloy by weight.

15. The article of claim 14, wherein the substrate is a component of a turbine engine.

16. The article of claim 1, wherein adhesion layer comprises a rough coating, and the first phase forms a plurality of bumps along a surface of the adhesion layer.

17. The article of claim 16, wherein the braze alloy forms a film that bonds the particles to the substrate.

18. The article of claim 17, wherein the thin film is continuous.

19. The article of claim 16, wherein the braze alloy has a lower melting point than the first phase.

20. The article of claim 19, wherein the braze alloy comprises a nickel-base or cobalt-base alloy, and at least one component for lowering the melting point of the braze alloy.

21. The article of claim 20, wherein the component for lowering the melting point of the braze alloy is selected from the group consisting of silicon, boron, phosphorous, and combinations thereof.

22. The article of claim 21, wherein the component for lowering the melting point of the braze alloy is selected from the group consisting of silicon, boron, and combinations thereof.

23. The article of claim 16, wherein the first phase comprises superalloy particles.

24. The article of claim 23, wherein the superalloy particles comprise MCrAlY, wherein M is selected from the group consisting of iron, nickel, cobalt, and combinations thereof.

25. The article of claim 24, wherein the superalloy particles are a nickel-base or cobalt-base superalloy, and nickel or cobalt is the single greatest element of the superalloy by weight.

26. The article of claim 23, wherein the first phase has an average particle size of about 125 microns to about 4000 microns.

27. The article of claim 16, wherein the adhesion layer has a roughness Ra in a range of about 100 to about 1000 microinches.

28. The article of claim 1, wherein the ceramic layer comprises a thermal barrier coating.

29. The article of claim 28, wherein the thermal barrier coating comprises stabilized zirconia.

30. The article of claim 29, wherein the zirconia is stabilized with at least one component selected from the group consisting of yttria, magnesia, ceria, scandia, and calcia.

31. An article comprising:

a superalloy substrate;

an adhesion layer overlying the substrate, the adhesion layer comprising a first phase comprised of nickel-based or cobalt-base surperalloy particles and a second phase comprised of a nickel-base or a cobalt-base braze alloy that bonds tha particles to the substrate, the second phase having a lower melting temperature than the first phase; and a thermal barrier coating overlying the adhesion layer, the thermal barrier coating comprising stabilized zirconia.

* * * * *